US008928443B2

(12) United States Patent
Hyde et al.

(10) Patent No.: US 8,928,443 B2
(45) Date of Patent: Jan. 6, 2015

(54) ELECTRICAL DEVICE WITH EMERGENCY COOLING SYSTEM

(75) Inventors: Roderick A. Hyde, Redmond, WA (US); Jordin T. Kare, Seattle, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 0 days.

(21) Appl. No.: 13/474,538

(22) Filed: May 17, 2012

(65) Prior Publication Data

US 2013/0307654 A1 Nov. 21, 2013

(51) Int. Cl.
*H01F 27/10* (2006.01)
*H01F 27/02* (2006.01)
*H01F 27/28* (2006.01)

(52) U.S. Cl.
CPC ..... *H01F 27/10* (2013.01); *H01F 27/2876* (2013.01)
USPC ..... 336/57; 336/58; 336/94; 336/182

(58) Field of Classification Search
USPC ..... 336/57–60, 94, 179, 182, 184
See application file for complete search history.

(56) References Cited

U.S. PATENT DOCUMENTS 2,748,356 A * 5/1956 Kaehni ..... 336/58
3,895,246 A 7/1975 Fidei et al.
3,983,427 A 9/1976 Ulke
4,337,569 A 7/1982 Pierce
5,508,672 A * 4/1996 Sokai ..... 336/57
5,806,324 A 9/1998 Shaw
6,909,349 B1 * 6/2005 Longardner et al. ..... 336/60
7,227,754 B2 * 6/2007 Griesinger et al. ..... 361/714
2002/0113599 A1 8/2002 Hoffman
2002/0161558 A1 10/2002 Georges et al.
2008/0065576 A1 3/2008 Friedlander et al.
2011/0140820 A1 * 6/2011 Guentert et al. ..... 336/58
2011/0285339 A1 11/2011 Hyde et al.
2012/0044032 A1 2/2012 Sathe et al.

OTHER PUBLICATIONS

PCT International Search Report; International App. No. PCT/US2013/039715; Sep. 6, 2013; pp. 1-2.

* cited by examiner

*Primary Examiner* — Mangtin Lian
(74) *Attorney, Agent, or Firm* — Foley & Lardner LLP

(57) ABSTRACT

An electrical device includes a winding, a primary cooling system, a secondary cooling system, and an actuator. The winding includes an interior portion and an exterior surface. The primary cooling system cools the exterior surface of the winding. The secondary cooling system cools the interior portion of the winding. The actuator is configured to actuate the secondary cooling system in response to a sensed condition of the electrical device or a predicted condition of the electrical device.

11 Claims, 12 Drawing Sheets

ELECTRICAL DEVICE WITH EMERGENCY COOLING SYSTEM

BACKGROUND

The present invention relates generally to the field of electrical devices. The present invention relates mores specifically to inductive electrical devices including transformers, inductors, and motors.

Transformers and other inductive electrical devices are subject to failure due to overheating. Large transformers are typically equipped with a cooling system configured to prevent overheating of the transformer during normal steady-state operation. However, transient events may cause the transformer to experience a rapid increase in temperature that the cooling system cannot handle, resulting in the transformer overheating and failing. There is a need for improved inductive electrical devices that can withstand increased temperatures due to transient events.

SUMMARY

One embodiment of the invention relates to an electrical device including a winding, a primary cooling system, a secondary cooling system, and an actuator. The winding includes an interior portion and an exterior surface. The primary cooling system cools the exterior surface of the winding. The secondary cooling system cools the interior portion of the winding. The actuator is configured to activate the secondary cooling system in response to a sensed condition of the electrical device or a predicted condition of the electrical device.

Another embodiment of the invention relates to an electrical device including a primary winding, a secondary winding, a primary cooling system, a secondary cooling system, and an actuator. The primary winding includes an interior portion and an exterior surface. The secondary winding includes interior portion and an exterior surface. The primary cooling system cools the exterior surface of the primary winding and the exterior surface of the secondary winding. The secondary cooling system cools the interior portion of the primary winding and the interior portion of the secondary winding. The actuator is configured to activate the secondary cooling system in response to an activation signal indicating a sensed condition of the electrical device or a predicted condition of the electrical device.

Another embodiment of the invention relates to a transformer including a core, a winding wrapped around the core, a primary cooling system, a secondary cooling system, and an actuator. The winding includes an interior portion and an exterior surface. The primary cooling system cools the exterior surface of the winding. The secondary cooling system cools the interior portion of the winding. The actuator is configured to activate the secondary cooling system in response to an activation signal indicating a sensed condition of the transformer or a predicted condition of the transformer.

Another embodiment of the invention relates to a transformer including a core, a primary winding wrapped around the core, a secondary winding wrapped around the core, a primary cooling system, a secondary cooling system, and an actuator. The primary winding includes an interior portion and an exterior surface. The secondary winding includes an interior portion and an exterior surface. The primary cooling system cools the exterior surface of the primary winding and the exterior surface of the secondary winding. The secondary cooling system cools the interior portion of the primary winding and the interior portion of the secondary winding. The actuator is configured to activate the secondary cooling system in response to an activation signal indicating a sensed condition of the transformer or a predicted condition of the transformer.

Another embodiment of the invention relates to a method of cooling an electrical device including a winding having an interior portion and an exterior surface, the method comprising. The method includes cooling the exterior surface of the winding with a primary cooling system, generating an activation signal in response to a sensed condition of the electrical device or a predicted condition of the electrical device, activating a secondary cooling system in response to the activation signal, and cooling the interior portion of the winding with the secondary cooling system.

Another embodiment of the invention relates to an electrical device including a winding, a primary cooling system, a secondary cooling system, and a heat exchanger. The winding includes an interior portion and an exterior surface. The primary cooling system cools the exterior surface of the winding. The secondary cooling system cools the interior portion of the winding. The heat exchanger is thermally coupled to the primary cooling system and the secondary cooling system.

Another embodiment of the invention relates to an electrical device including a primary winding, a secondary winding, a primary cooling system, a secondary cooling system, and a heat exchanger. The primary winding includes an interior portion and an exterior surface. The secondary winding includes an interior portion and an exterior surface. The primary cooling system cools the exterior surface of the primary winding and the exterior surface of the secondary winding. The secondary cooling system cools the interior portion of the primary winding and the interior portion of the secondary winding. The heat exchanger is thermally coupled to the primary cooling system and the secondary cooling system.

Another embodiment of the invention relates to a transformer including a core, a winding wrapped around the core, a primary cooling system, a secondary cooling system, and a heat exchanger. The winding includes an interior portion and an exterior surface. The primary cooling system cools the core and the exterior surface of the winding. The secondary cooling system cools the interior portion of the winding. The heat exchanger is thermally coupled to the primary cooling system and the secondary cooling system.

Another embodiment of the invention relates to a transformer including a core, a primary winding wrapped around the core, a secondary winding wrapped around the core, a primary cooling system, a secondary cooling system, and a heat exchanger. The primary winding includes an interior portion and an exterior surface. The secondary winding includes an interior portion and an exterior surface. The primary cooling system cools the core, the exterior surface of the primary winding, and the exterior surface of the secondary winding. The secondary cooling system cools the interior portion of the primary winding and the interior portion of the secondary winding. The heat exchanger is thermally coupled to the primary cooling system and the secondary cooling system.

Another embodiment of the invention relates to a method of cooling an electrical device including a winding having an interior portion and an exterior surface. The method includes cooling the exterior surface of the winding with a primary cooling system, cooling the interior portion of the winding with a secondary cooling system, and thermally coupling the primary cooling system and the secondary cooling system to a shared heat exchanger.

Another embodiment of the invention relates to an electrical device including a winding, a primary cooling system, and a secondary cooling system. The winding includes an interior portion and an exterior surface. The primary cooling system cools the exterior surface of the winding. The secondary cooling system cools the interior portion of the winding and has a heat pipe in a heat exchange relationship with the interior portion of the winding.

Another embodiment of the invention relates to an electrical device including a primary winding, a secondary winding, a primary cooling system, and a secondary cooling system. The primary winding includes an interior portion and an exterior surface. The secondary winding includes an interior portion and an exterior surface. The primary cooling system cools the exterior surface of the primary winding and the exterior surface of the secondary winding. The secondary cooling system cools the interior portion of the primary winding and the interior portion of the secondary winding and has multiple heat pipes where a first pipe is in a heat exchange relationship with the interior portion of the primary winding and a second heat pipe is in a heat exchange relationship with the interior portion of the secondary winding.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this application are contemplated as being part of the inventive subject matter disclosed herein.

BRIEF DESCRIPTION OF THE FIGURES

The skilled artisan will understand that the drawings primarily are for illustrative purposes and are not intended to limit the scope of the inventive subject matter described herein.

The features and advantages of the inventive concepts disclosed herein will become more apparent from the detailed description set forth below when taken in conjunction with the drawings.

DETAILED DESCRIPTION

Referring generally to the Figures, electrical devices including a primary cooling system and a secondary cooling system and methods of cooling electrical devices with a primary cooling system and a secondary cooling system are shown and described. A transformer is used in the exemplary embodiments shown in the figures and described below. However, the teachings of the present application are applicable to other electrical devices, particularly inductive electrical devices including motors, inductors, and generators.

Figure 1:
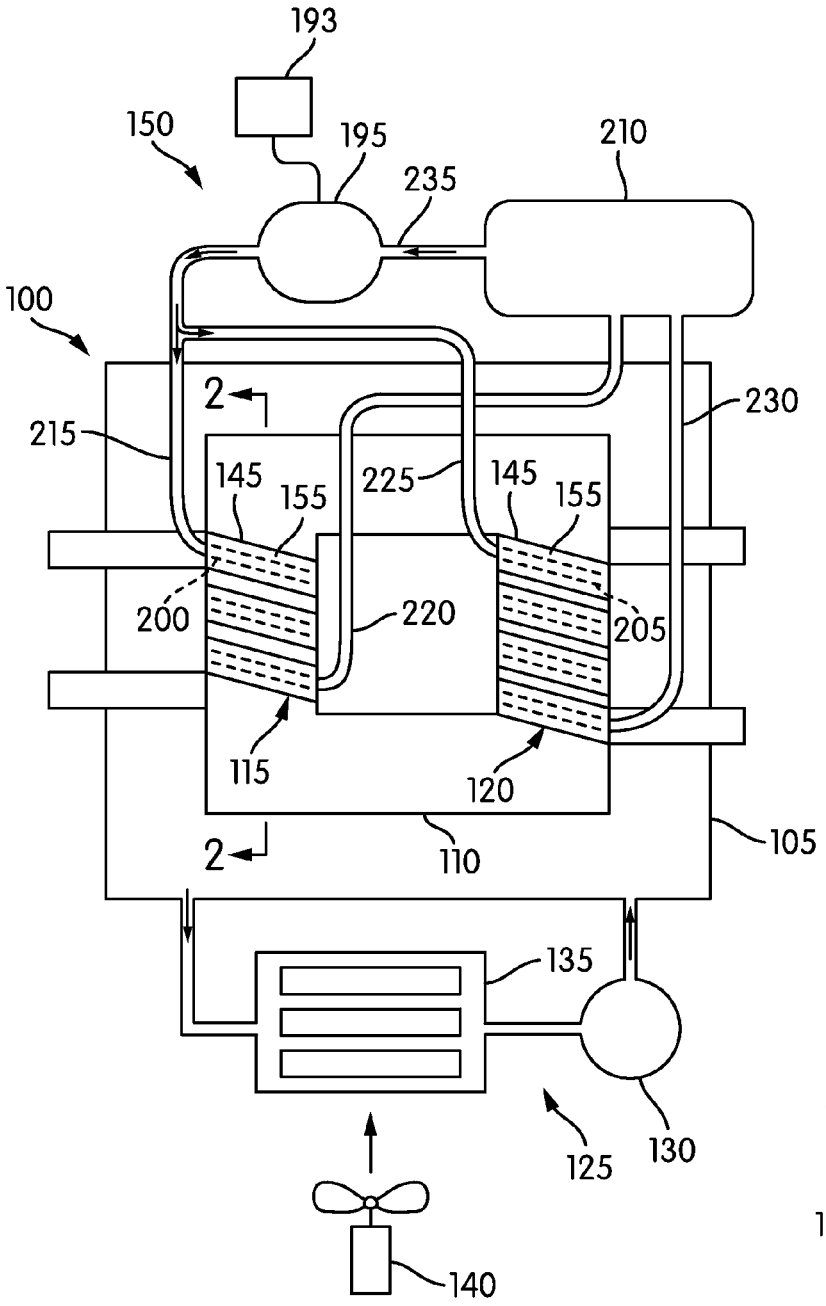
FIG. 1 is a schematic diagram of an electrical device, shown according to an exemplary embodiment.

Referring to FIG. 1, a transformer 100 includes a housing or tank 105, a core 110, a primary winding 115, and a secondary winding 120. The windings 115 and 120 are wrapped around the core 110. In use, a varying primary current through the primary winding 115 creates a varying magnetic field in the core 110. The varying magnetic field in the core 115 induces a varying secondary current through the secondary winding 120. The two windings 115 and 120 are said to be inductively coupled together. The passage of current through the windings 115 and 120 gives off heat. Increasing the current through the windings 115 and 120 increases the heat generated. When too much heat is generated due to high current, the resulting high temperatures can damage the transformer, even causing the transformer to fail. A primary cooling system 125 functions to transfer heat away from the core and the windings to keep the transformer within a range of temperatures in which the transformer can safely operate.

Depending on the size of the transformer 100, various types of primary cooling systems 125 can be used, including air cooling by normal ventilation, air cooling by forced air, water cooling, or liquid cooling. In a liquid-cooled transformer, the core 110 and the windings 115 and 120 are submerged or immersed in a primary cooling fluid (e.g., transformer oil). The primary cooling fluid is stable at high temperatures and is an excellent electrical insulator. The primary cooling fluid functions both as an insulator and as a heat transfer medium to transfer heat away from the core and the windings towards the tank.

Several varieties of liquid-cooled transformers exist. FIG. 1 illustrates a fluid-forced, air-forced primary cooling system 125. The primary cooling system 125 includes a pump 130, a heat exchanger 135, and a fan 140. The pump 130 circulates the primary cooling fluid from the tank 105, through the heat exchanger 135, and back to the tank 105 as shown by the arrows in FIG. 1. The fan 140 forces air across the heat exchanger 140 as shown by the arrow in FIG. 1 to remove heat from the primary cooling fluid passing through the heat exchanger 140. The primary cooling system 125 is configured to prevent overheating of the transformer 100 during normal steady-state operation of the transformer 100. The primary cooling system 125 is in a heat-exchange relationship with the exterior surface of the core 110 and with the exterior surfaces 145 of the windings 115 and 120 and can only remove heat from the exterior surface of the core 110 and the exterior surfaces 145 of the windings 115 and 120. However, the primary cooling system 125 is not equipped to handle a short-term rapid increase in current through the transformer 100 and the associated high temperature resulting from a harmful transient event.

Harmful transient events capable of producing a current and associated temperature sufficient to damage a transformer 100 include solar flares, electromagnetic pulses, grid fault conditions, and other events that generate large DC currents in the transmission lines connected to a transformer 100. Electromagnetic pulses caused by the detonation of a nuclear bomb are of particular concern. Electromagnetic pulse attacks in which a nuclear bomb is detonated at high altitude are capable of damaging a large number of transformers and thereby causing serious disruptions to a power grid.

A harmful transient event causes a large increase in the current in one or both of the windings 115 and 120. The increased current causes the temperature in windings 115 and 120 to rise to a threshold value where one or both of the windings 115 and 120 will fail (e.g., melt), thereby causing the transformer 100 to fail. The temperature of the winding 115 or 120 is considered to be unsafe at a temperature above this threshold value.

An emergency or secondary cooling system 150 protects the transformer from harmful transient events by removing the heat resulting from a harmful transient event. To maintain the windings 115 and 120 below an unsafe temperature during a harmful transient event, the additional heat caused by the harmful transient event must be removed from the windings 115 and 120. The secondary cooling system 150 does so by removing heat from the interior portion 155 of each winding 115 and 120. This removes heat from the windings 115 and 120 more quickly than the primary cooling system 125 alone because there is no need to allow the heat in the interior portion 155 to propagate to the exterior surface 145 for removal by the primary cooling system 125.

The secondary cooling system 150 is in a heat exchange relationship with the interior portions 155 of the windings 115 and 120. In this way, the excess heat caused by a harmful transient event can quickly be moved away from the interior portions 155 of the windings 115 and 120. A harmful transient event by its vary nature lasts for a relatively short period of time. Therefore, the secondary cooling system 150 at a minimum needs to provide cooling for the duration of the harmful transient event. In other embodiments, the secondary cooling system 150 is able to provide cooling before, during, and after a harmful transient event.

Figure 3:
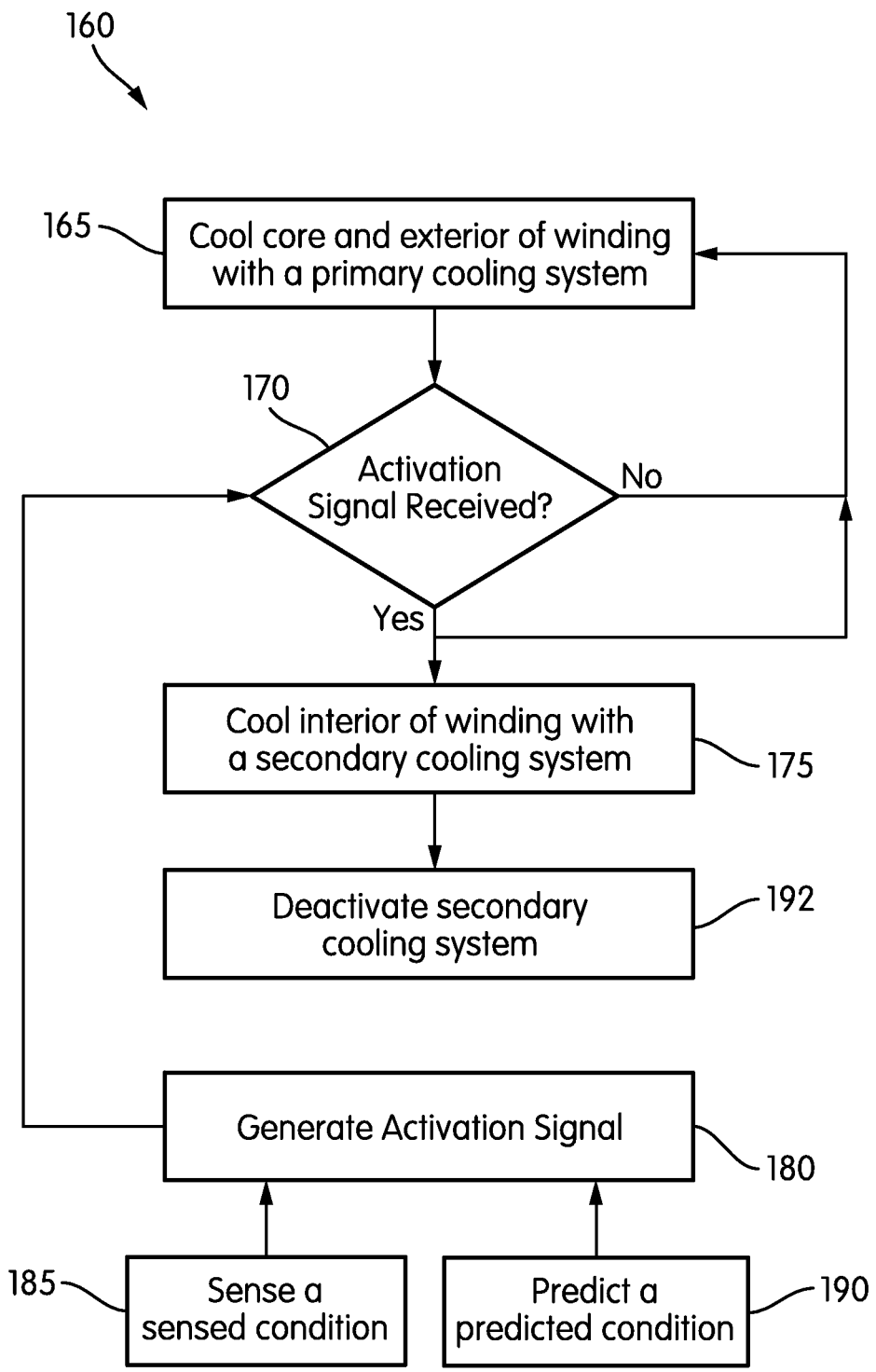
FIG. 3 is a flowchart of a process for cooling an electrical device, shown according to an exemplary embodiment.

The secondary cooling system 150 only needs to be activated at times when the temperature of the windings 115 and 120 is at an unsafe temperature or predicted to reach an unsafe temperature. Referring to FIG. 3, a process 160 for cooling a transformer 100 is described. The process 160 includes cooling the core 110 and the exterior surfaces 145 of the windings 115 and 120 with the primary cooling system 125 (step 165), determining if an activation signal has been received (step 170), and cooling the interior portions 155 of the windings 115 and 120 with the secondary cooling system 150 upon receipt of the activation signal (step 175). The process 160 further includes generating the activation signal (step 180) in response to either sensing a sensed condition (step 185) or in response to predicting a predicted condition (step 190). Finally, the secondary cooling system 150 is deactivated (step 192) when no longer needed.

The activation signal for activating the secondary cooling system 150 is generated in response to a sensed condition indicative of an unsafe temperature in one or both of the windings 115 and 120 or in response to a predicted condition that anticipates an unsafe temperature in one or both of the windings 115 and 120. Sensed conditions can include a current through the transformer 100 above a threshold value, a current through one of the windings 115 and 120 above a threshold value, a voltage across one of the windings 115 and 120, a temperature in the transformer 100 above a threshold value, a temperature in the core 110, one of the windings 115 and 120, the primary cooling system 120, or the primary cooling fluid above a threshold value, a magnetic flux in the core 110 above a threshold value, or other conditions of the transformer 110 capable of measurement and indicative of an unsafe temperature in one or both of the windings 115 and 120. Sensed conditions can be sensed or detected by sensors, probes, or other measuring devices coupled to the transformer 100. Predicted conditions include increased current through the transformer 100 due to a harmful transient event, increased current through one or both of the windings 115 and 120 due to a harmful transient event, the increased current can be measured for amount and for duration to determine the predicted condition, an increased temperature in the transformer 100 due to a harmful transient event, an increased temperature in the core 110, one of the windings 115 and 120, the primary cooling system 120, or the primary cooling fluid due to a harmful transient event, an increased magnetic flux in the core 100 due to a harmful transient event, or other conditions of the transformer 100 capable of prediction based on a harmful transient event. Harmful transient events, including solar flares and electromagnetic pulses, can be predicted by sensors, early warning systems, or other devices capable of identifying occurrences that indicate one of these transient events will occur in the near future.

Figure 2:
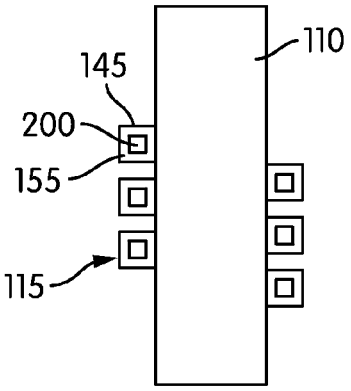
FIG. 2 is a schematic cross section along line 2-2 of a portion of the electrical device of FIG. 1.

Referring to FIGS. 1-2, a secondary cooling system 150 is shown, according to an exemplary embodiment. The secondary cooling system 150 includes an actuator 193, a pump 195, a primary winding passage 200 formed within the interior portion 150 of the primary winding 115 (shown in FIG. 2), a secondary winding passage 205 formed within the interior portion 150 of the secondary winding 120, a fluid return reservoir 210, a secondary cooling fluid, and multiple conduits. Conduit 215 connects the pump 195 and the primary winding passage 200. Conduit 220 connects the primary winding passage 200 and the fluid return reservoir 210. Conduit 225 connects the pump 195 and the secondary winding passage 205. Conduit 230 connects the secondary winding passage 205 and the fluid return reservoir 210. Conduit 235 connects the fluid return reservoir 210 and the pump 195.

The pump 195 is considered to be a high-pressure fluid source. In response to the activation signal, the actuator 193 activates the secondary cooling system 150. The actuator 193 is a controller, processor, or other component capable of receiving an input signal and generating an output signal in response to the input signal. In some embodiments, the actuator 193 is further configured to change the thermal performance of the secondary cooling system 150 (e.g., changing the flow rate or temperature of the cooling fluid through the secondary cooling system 150). The pump 195 provides the secondary cooling fluid at high pressure to the primary winding passage 200 and the secondary winding passage 205. The secondary cooling fluid is provided at a temperature below the temperature of the windings 115 and 120 so that heat is transferred from the windings 115 and 120 to the secondary cooling fluid. After passing through the primary winding passage 200 and the secondary winding passage 205, the secondary cooling fluid is conveyed to the fluid return reservoir 210. The fluid return reservoir 210 is in fluid communication with the pump 195 via conduit 235 to allow the secondary cooling fluid to return to the pump 195 for recirculation, if necessary. This is a closed loop system in which the cooling fluid returns to its source, the pump 195. Alternatively, the primary cooling system 125 and the secondary cooling system 150 share the cooling fluid and the cooling fluid is directed or provided to the secondary cooling system 150 as needed.

Referring generally to FIGS. 4-14, various exemplary embodiments of a secondary cooling system are shown and described. The secondary cooling systems of FIGS. 4-10 and 13-14 may be implemented using the process 160 of FIG. 3.

Figure 4:
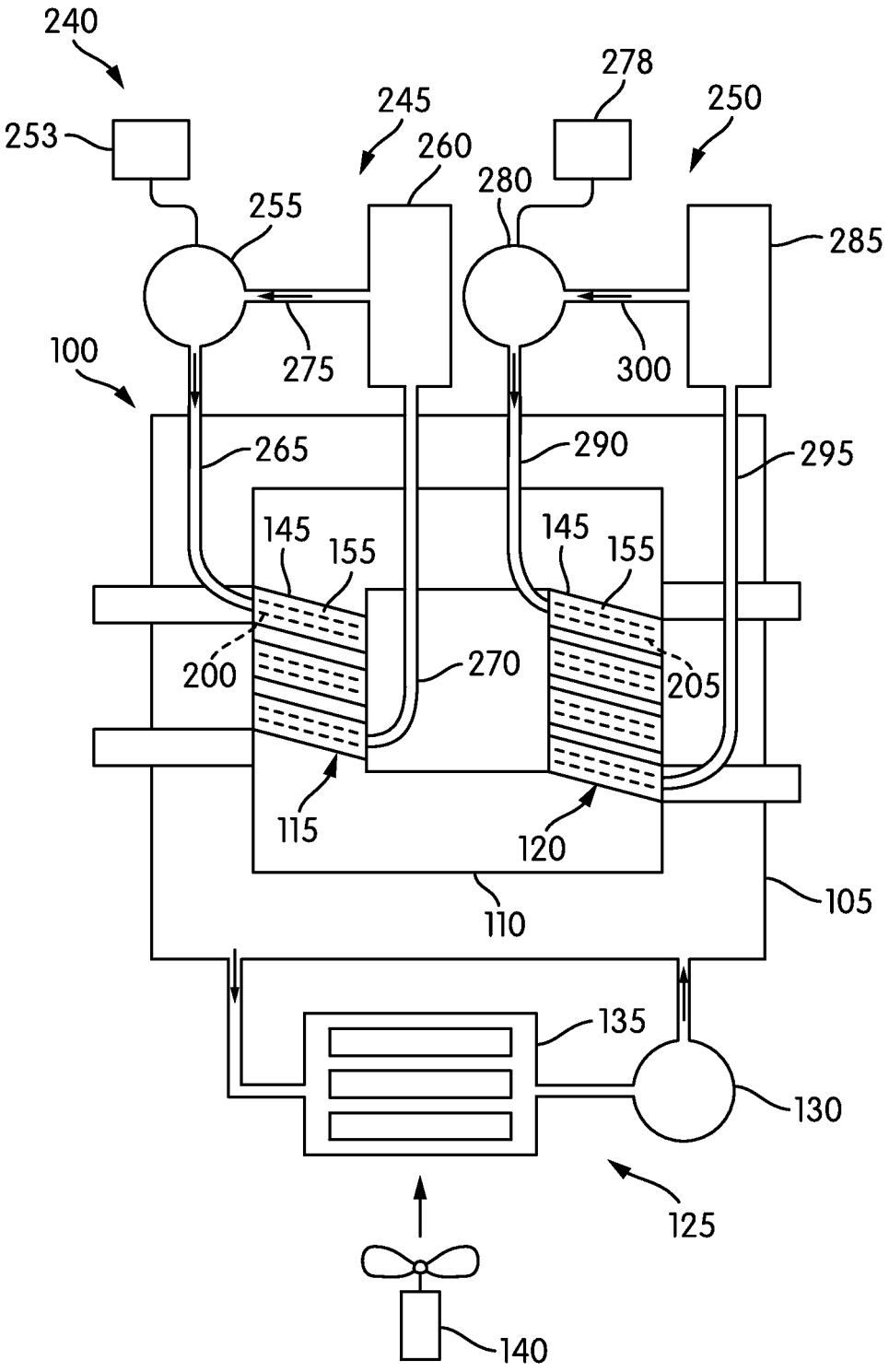
FIG. 4 is a schematic diagram of an electrical device, shown according to an exemplary embodiment.

Referring to FIG. 4, a transformer 100, a primary cooling system 125, and a secondary cooling system 240 are shown, according to an exemplary embodiment. The secondary cooling system 240 includes a primary winding cooling system 245 and a secondary winding cooling system 250. The primary winding cooling system 245 includes an actuator 253, a pump 255, the primary winding passage 200, a fluid return reservoir 260, a primary winding cooling fluid, and multiple conduits. Conduit 265 connects the pump 255 and the primary winding passage 260. Conduit 270 connects the primary winding passage 260 and the fluid return reservoir 260. Conduit 275 connects the fluid return reservoir 260 and the pump 255. The secondary winding cooling system 250 includes an actuator 278, a pump 280, the secondary winding passage 205, a fluid return reservoir 285, a secondary winding cooling fluid, and multiple conduits. Conduit 290 connects the pump 280 and the secondary winding passage 290. Conduit 295 connects the secondary winding passage 290 and the fluid return reservoir 285. Conduit 300 connects the fluid return reservoir 285 and the pump 280. The secondary cooling system 240 functions similarly to the secondary cooling system 150, except that the primary winding 115 has a dedicated pump 255 and fluid return reservoir 260 and the secondary winding 120 has a dedicated pump 280 and fluid return reservoir 285 rather than the two windings 115 and 120 sharing a single pump 195 and a single fluid return reservoir 210. The pumps 255 and 280 are considered to be high-pressure fluid sources. Alternatively, the actuators 253 and 278 are combined in a single component.

Figure 5:
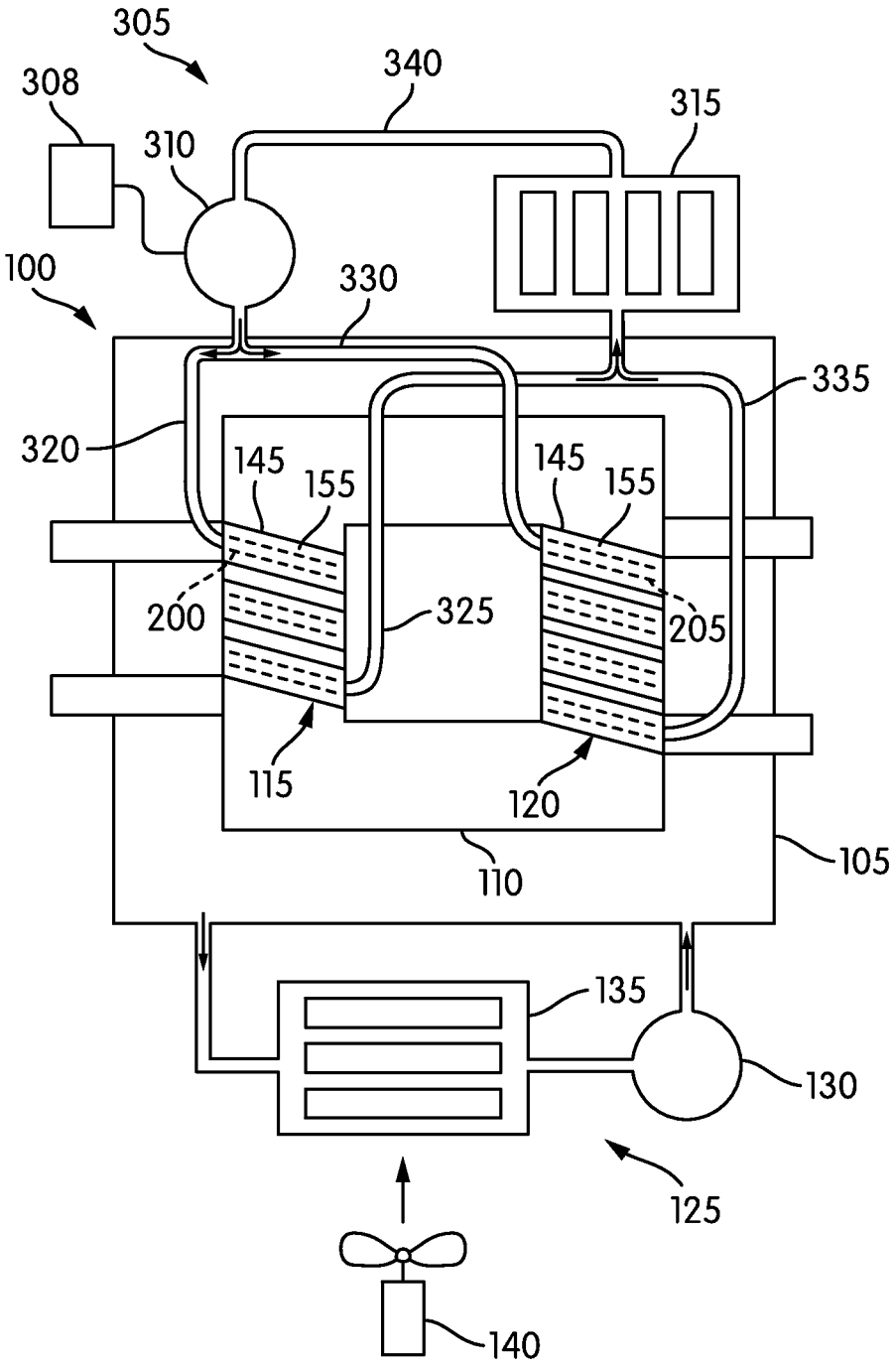
FIG. 5 is a schematic diagram of an electrical device, shown according to an exemplary embodiment.

Referring to FIG. 5, a transformer 100, a primary cooling system 125, and a secondary cooling system 305 are shown, according to an exemplary embodiment. The secondary cooling system 305 includes an actuator 308, a pump 310, the primary winding passage 200, the secondary winding passage 205, a heat exchanger 315, a secondary cooling fluid, and multiple conduits. Conduit 320 connects the pump 310 and the primary winding passage 200. Conduit 325 connects the primary winding passage 200 and the heat exchanger 315. Conduit 330 connects the pump 310 and the secondary winding passage 205. Conduit 335 connects the secondary winding passage 205 and the heat exchanger 315. Conduit 340 connects the heat exchanger 315 to the pump 310. The pump 310 is considered to be a high-pressure fluid source. In response to the activation signal, the actuator 308 activates the secondary cooling system 305. In some embodiments, the actuator 308 is further configured to change the thermal performance of the secondary cooling system 305 (e.g., changing the flow rate or temperature of the cooling fluid through the secondary cooling system 305). The pump 310 provides the secondary cooling fluid at high pressure to the primary winding passage 200 and the secondary winding passage 205. The secondary cooling fluid is provided at a temperature below the temperature of the windings 115 and 120 so that heat is transferred from the windings 115 and 120 to the secondary cooling fluid. After passing through the primary winding passage 200 and the secondary winding passage 205, the secondary cooling fluid is conveyed to the heat exchanger 315 where the now heated secondary cooling fluid is cooled. The heat exchanger 315 places the heated secondary cooling fluid in a heat exchange relationship with a heat exchange medium, which can be air provided by normal ventilation, forced air, or an additional cooling fluid or refrigerant. The heat exchange medium is provided at a temperature below that of the heated secondary cooling fluid. The heat exchanger 315 is in fluid communication with the pump 195 via conduit 340 to allow the secondary cooling fluid to return to the pump 310 for recirculation, if necessary.

Figure 6:
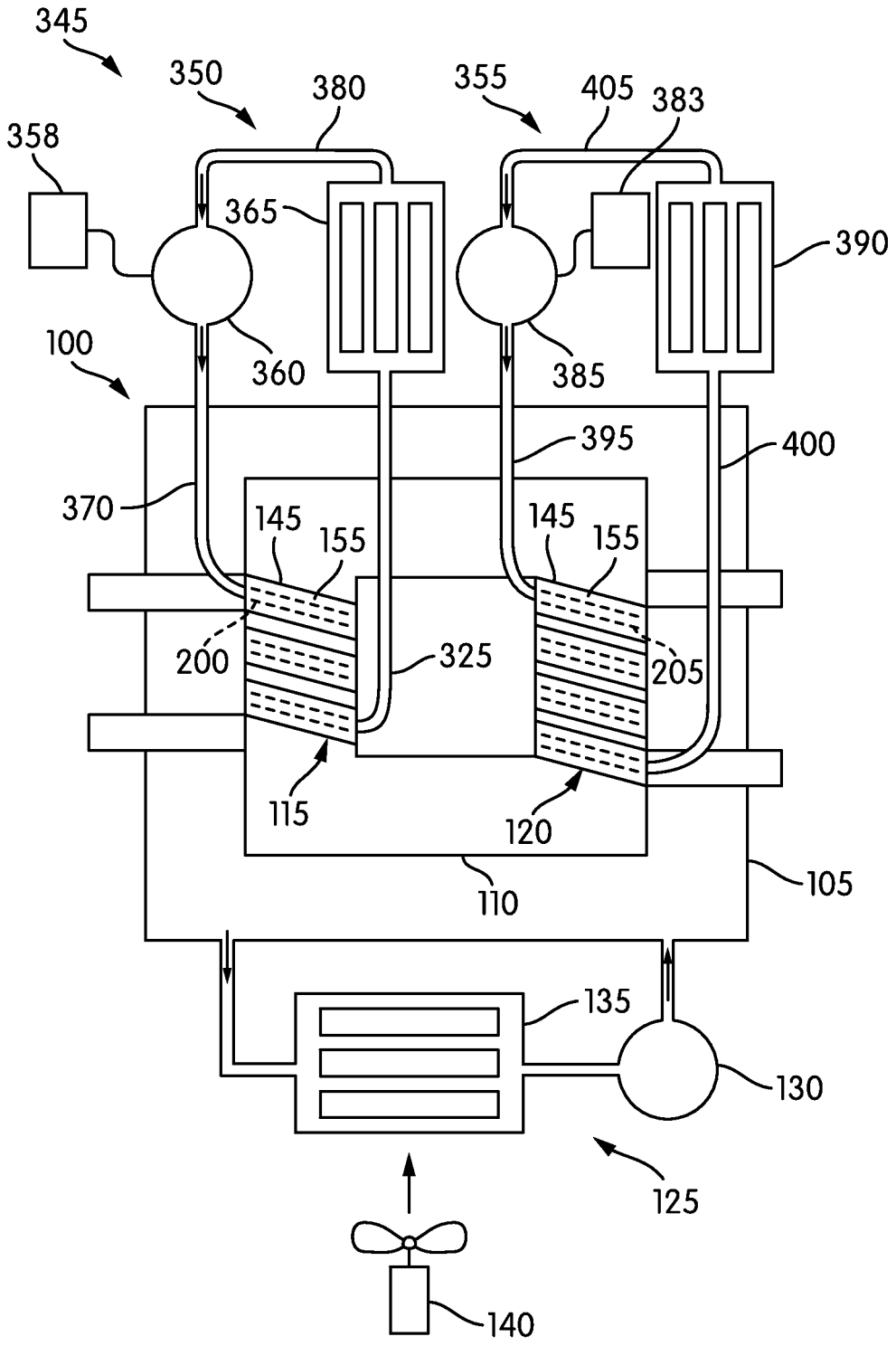
FIG. 6 is a schematic diagram of an electrical device, shown according to an exemplary embodiment.

Referring to FIG. 6, a transformer 100, a primary cooling system 125, and a secondary cooling system 345 are shown, according to an exemplary embodiment. The secondary cooling system 345 includes a primary winding cooling system 350 and a secondary winding cooling system 355. The primary winding cooling system 350 includes an actuator 358, a pump 360, the primary winding passage 200, a heat exchanger 365, a primary winding cooling fluid, and multiple conduits. Conduit 370 connects the pump 360 to the primary winding passage 200. Conduit 375 connects the primary winding passage 200 to the heat exchanger 365. Conduit 380 connects the heat exchanger 365 to the pump 360. The secondary winding cooling system 355 includes an actuator 383, a pump 385, the secondary winding passage 205, a heat exchanger 390, a secondary winding cooling fluid, and multiple conduits. Conduit 395 connects the pump 385 to the secondary winding passage 205. Conduit 400 connects the secondary winding passage 205 to the heat exchanger 390. Conduit 405 connects the heat exchanger 390 to the pump 385. The secondary cooling system 345 functions similarly to the secondary cooling system 350, except that the primary winding 115 has a dedicated pump 360 and heat exchanger 365 and the secondary winding 120 has a dedicated pump 385 and heat exchanger 390 rather than the two windings 115 and 120 sharing a single pump 310 and a single heat exchanger 315. The pumps 260 and 385 are considered to be high-pressure fluid sources. Alternatively, the actuators 358 and 365 are combined in a single component. Alternatively, the two heat exchangers 365 and 390 can be thermally coupled to one another.

Figure 7:
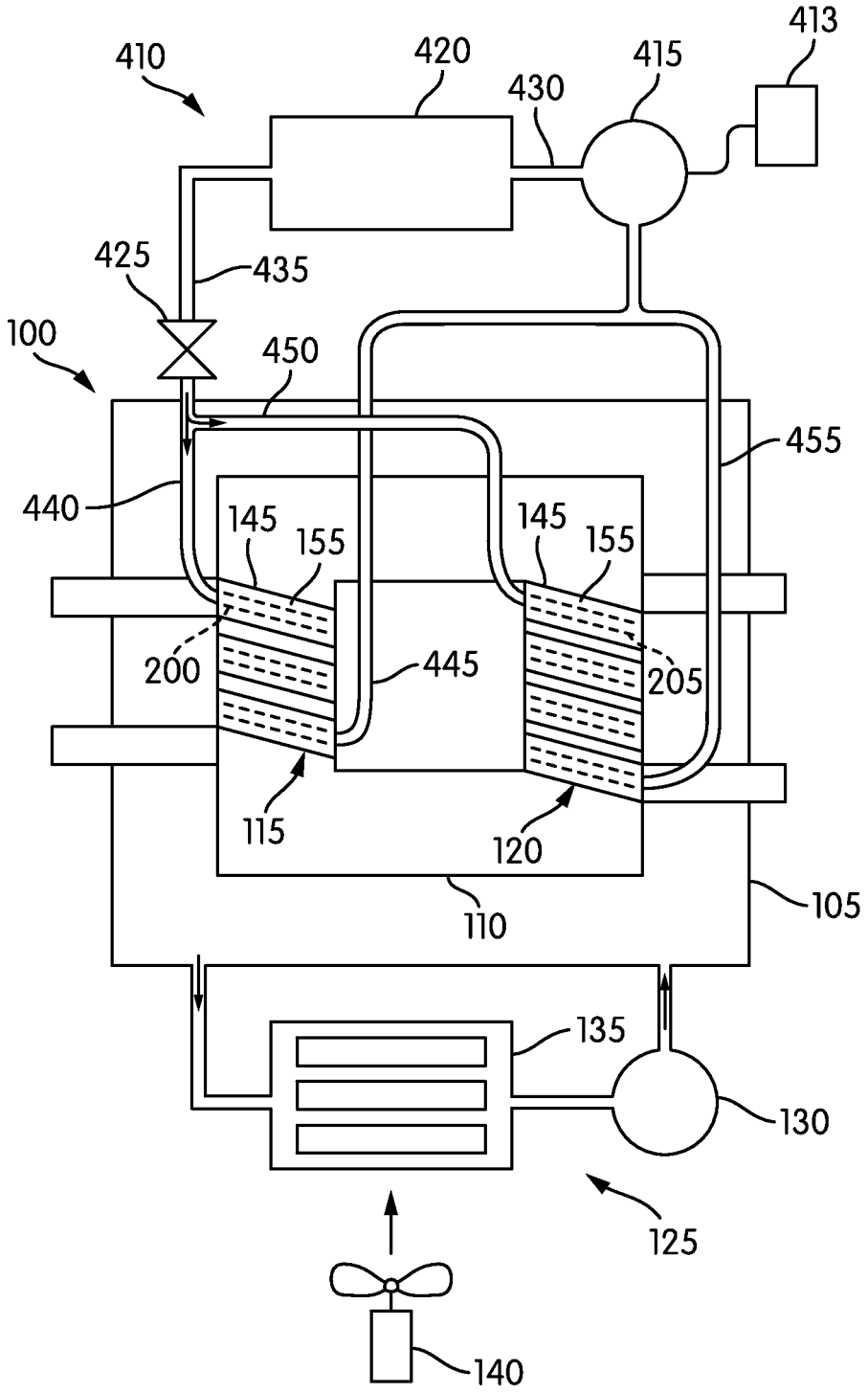
FIG. 7 is a schematic diagram of an electrical device, shown according to an exemplary embodiment.

Referring to FIG. 7, a transformer 100, primary cooling system 125, and a secondary cooling system 410 are shown, according to an exemplary embodiment. The secondary cooling system 410 includes an actuator 413, a compressor 415, a condenser 420, an expansion valve 425, the primary winding passage 200, the secondary winding passage 205, a secondary cooling fluid, and multiple conduits. Conduit 430 connects the compressor 415 and the condenser 420. Conduit 435 connects the condenser 420 and the expansion valve 425. Conduit 440 connects the expansion valve 425 and the primary winding passage 200. Conduit 445 connects the primary winding passage 200 and the compressor 415. Conduit 450 connects the expansion valve 425 and the secondary winding passage 205. Conduit 455 connects the secondary winding passage 205 and the compressor 415. In response to the activation signal, the actuator 413 activates the secondary cooling system 410. The secondary cooling system 410 operates as a heat pump with the primary winding passage 200 and the secondary winding passage 205 functioning as the evaporator. The secondary cooling fluid undergoes a vapor-compression cycle including a phase change within the passages 200 and 205 as a result of heat transferring from the interior portions 155 of the windings 115 and 120 to the secondary cooling fluid. The compressor 415 is considered to be a high-pressure fluid source.

Figure 8:
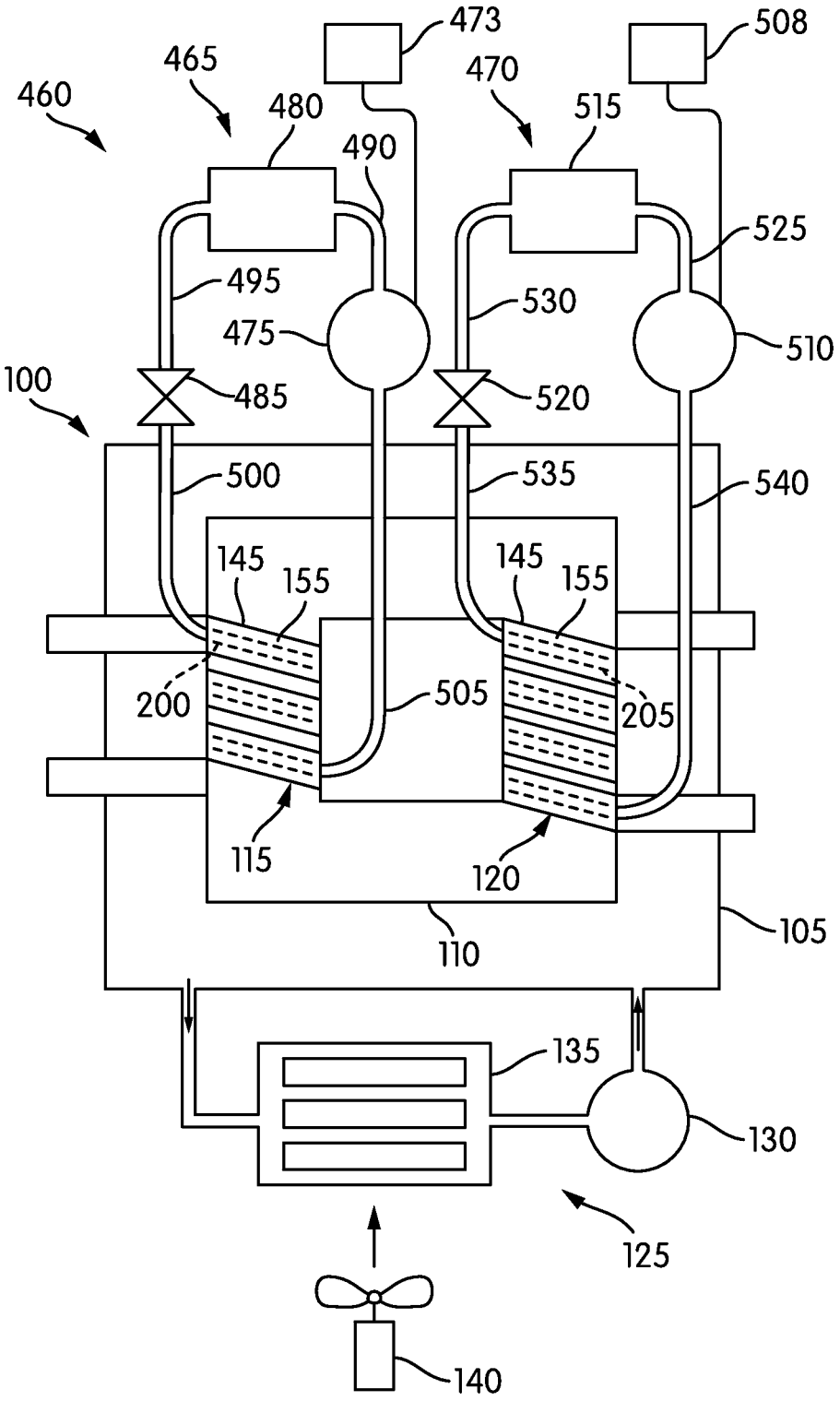
FIG. 8 is a schematic diagram of an electrical device, shown according to an exemplary embodiment.

Referring to FIG. 8, a transformer 100, a primary cooling system 125, and a secondary cooling system 460 are shown, according to an exemplary embodiment. The secondary cooling system 460 includes a primary winding cooling system 465 and a secondary winding cooling system 470. The primary winding cooling system 465 includes an actuator 473, a compressor 475, a condenser 480, an expansion valve 485, the primary winding passage 200, a primary winding cooling fluid or refrigerant, and multiple conduits. Conduit 490 connects the compressor 475 and the condenser 480. Conduit 495 connects the condenser 480 and the expansion valve 485. Conduit 500 connects the expansion valve 485 and the primary winding passage 200. Conduit 505 connects the primary winding passage 200 and the compressor 475. The secondary winding cooling system 470 includes an actuator 508, a compressor 510, a condenser 515, an expansion valve 520, the secondary winding passage 205, a secondary winding cooling fluid or refrigerant, and multiple conduits. Conduit 525 connects the compressor 510 and the condenser 515. Conduit 530 connects the condenser 515 and the expansion valve 520. Conduit 535 connects the expansion valve 520 and the secondary winding passage 205. Conduit 540 connects the secondary winding passage 205 and the compressor 510. The secondary cooling system 460 functions similarly to the secondary cooling system 410, except that the primary winding 115 has a dedicated compressor 475, condenser 480, and expansion valve 485 and the secondary winding 120 has a dedicated compressor 510, condenser 515, and expansion valve 520 rather than the two windings 115 and 120 sharing a single compressor 415, a single condenser 420, and a single expansion valve 425. The compressors 475 and 510 are considered to be high-pressure fluid sources. Alternatively, the actuators 473 and 508 are combined in a single component.

Figure 9:
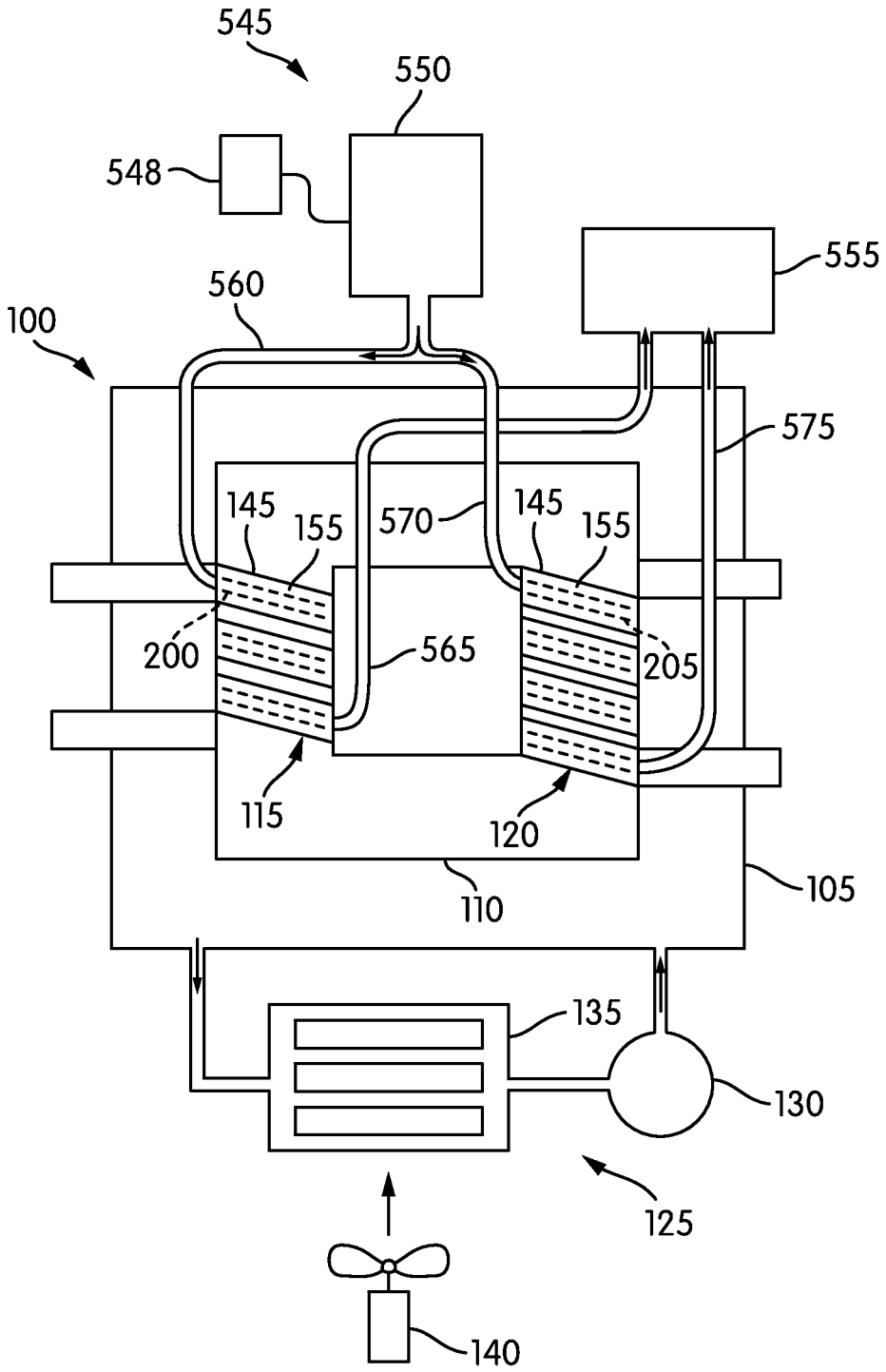
FIG. 9 is a schematic diagram of an electrical device, shown according to an exemplary embodiment.

Referring to FIG. 9, a transformer 100, a primary cooling system 125, and a secondary cooling system 545 are shown, according to an exemplary embodiment. The secondary cooling system 545 includes an actuator 548, an accumulator 550, the primary winding passage 200, the secondary winding passage 205, a fluid return reservoir 555, a secondary cooling fluid, and multiple conduits. Conduit 560 connects the accumulator 550 to the primary winding passage 200. Conduit 565 connects the primary winding passage 200 to the fluid return reservoir 555. Conduit 570 connects the accumulator 550 to the secondary winding passage 205. Conduit 575 connects the secondary winding passage 205 to the fluid return reservoir 555. The accumulator 550 stores the secondary cooling fluid under pressure. The accumulator 550 is considered to be a high-pressure fluid source. In response to the activation signal, the actuator 548 activates the secondary cooling system 545. In some embodiments, the actuator 548 is further configured to change the thermal performance of the secondary cooling system 545 (e.g., changing the flow rate or temperature of the cooling fluid through the secondary cooling system 545). The accumulator 550 provides the secondary cooling fluid at high pressure to the primary winding passage 200 and the secondary winding passage 205. The secondary cooling fluid is provided at a temperature below the temperature of the windings 115 and 120 so that heat is transferred from the windings 115 and 120 to the secondary cooling fluid. After passing through the primary winding passage 200 and the secondary winding passage 205, the secondary cooling fluid is conveyed to the fluid return reservoir 555.

Figure 10:
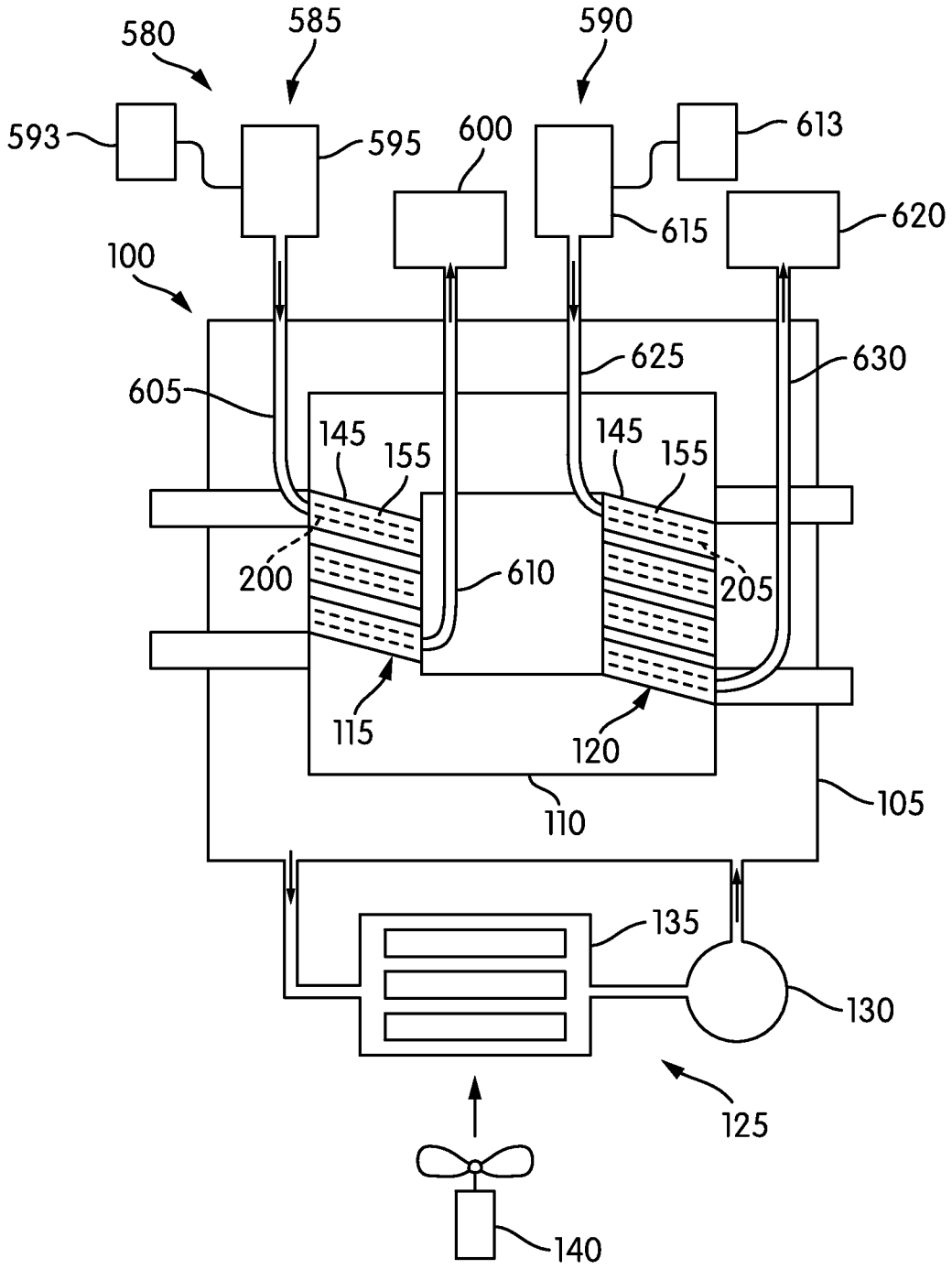
FIG. 10 is a schematic diagram of an electrical device, shown according to an exemplary embodiment.

Referring to FIG. 10, a transformer 100, a primary cooling system 125, and a secondary cooling system 580 are shown, according to an exemplary embodiment. The secondary cooling system 580 includes a primary winding cooling system 585 and a secondary winding cooling system 590. The primary winding cooling system 585 includes an actuator 593, an accumulator 595, the primary winding passage 200, a fluid return reservoir 600, a primary winding cooling fluid, and multiple conduits. Conduit 605 connects the accumulator 595 and the primary winding passage 200. Conduit 610 connects the primary winding passage 200 and the fluid return reservoir 600. The secondary winding cooling system 590 includes an actuator 613, an accumulator 615, the secondary winding passage 205, a fluid return reservoir 620, a secondary winding cooling fluid, and multiple conduits. Conduit 625 connects the accumulator and 615 the secondary winding passage 205. Conduit 630 connects the secondary winding passage 205 and the fluid return reservoir 620. The secondary cooling system 580 functions similarly to the secondary cooling system 545, except that the primary winding 115 has a dedicated accumulator 595 and fluid return reservoir 600 and the secondary winding 120 has a dedicated accumulator 615 and fluid return reservoir 620 rather than the two windings 115 and 120 sharing a single accumulator 550 and a single fluid return reservoir 555. The accumulators 595 and 615 are considered to be high-pressure fluid sources. Alternatively, the actuators 593 and 613 are combined in a single component.

Figure 11:
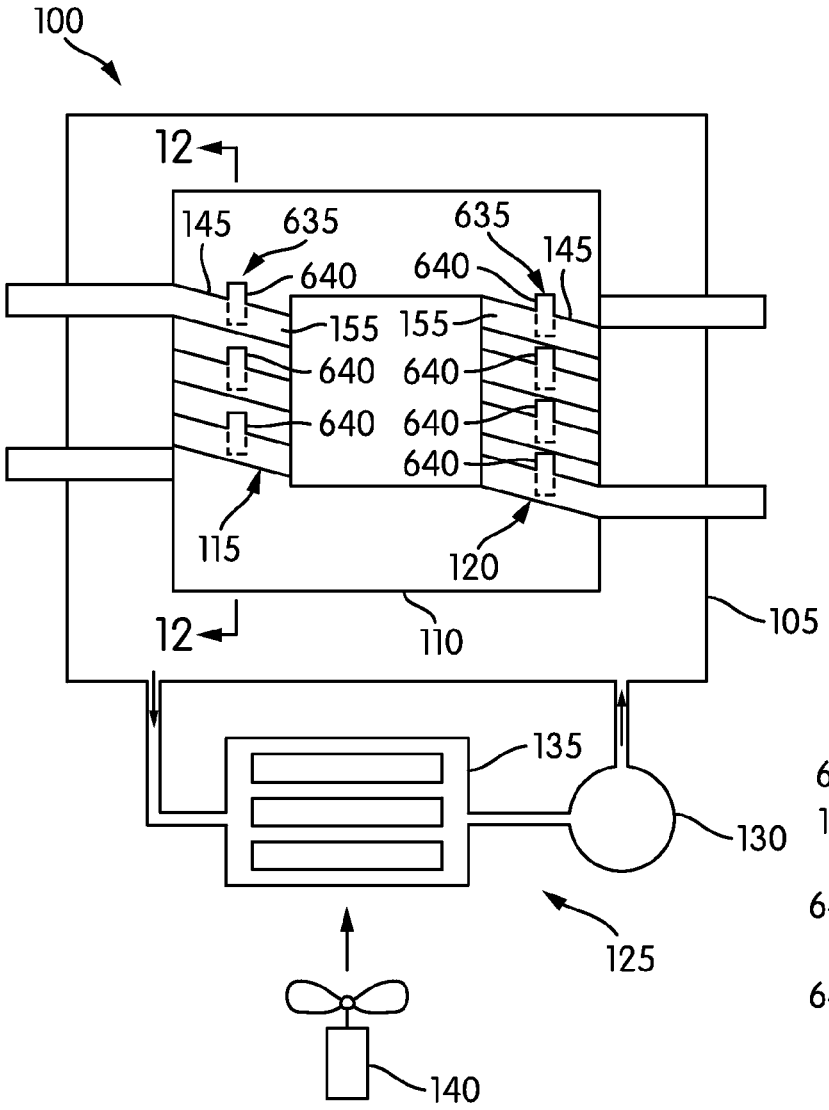
FIG. 11 is a schematic diagram of an electrical device, shown according to an exemplary embodiment.
Figure 12:
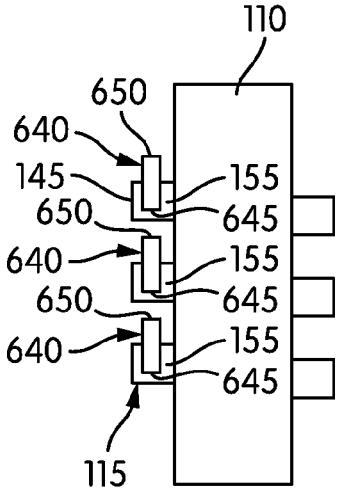
FIG. 12 is a schematic cross section along line 12-12 of a portion of the electrical device of FIG. 11.

Referring to FIGS. 11-12, a transformer 100, a primary cooling system 125, and a secondary cooling system 635 are shown, according to an exemplary embodiment. The secondary cooling system 635 is in a heat exchange relationship with the interior portions 155 of the windings 115 and 120. The secondary cooling system 635 includes multiple heat pipes 640. Each heat pipe 640 includes a hot end 645 and a cold end 650. Each heat pipe 640 is coupled to either the primary winding 115 or the secondary winding 120. As shown in FIG. 12, each hot end 645 is positioned in or thermally coupled to the interior portion 155 of the winding and the cold end 650 is positioned outside of the winding. In a liquid-cooled transformer, the cold ends 650 are positioned in or thermally coupled to the primary cooling fluid of the primary cooling system 125. Each heat pipe 640 functions to transfer heat from the hot end 645 in the interior portion 155 of the winding to the cold end 650 outside of the winding by subjecting a secondary cooling fluid contained within the heat pipe 640 to a phase change. At the hot end 645, liquid secondary cooling fluid is vaporized due to heat absorbed from the winding. The vaporized cooling fluid migrates to the cold end 650, where the vaporized cooling fluid condenses to liquid cooling fluid, releasing the latent heat absorbed at the hot end 645. The liquid cooling fluid then returns to the hot end 645, typically by gravity or capillary action. A wick can be included inside the heat pipe 640 to promote the capillary action.

Figure 13:
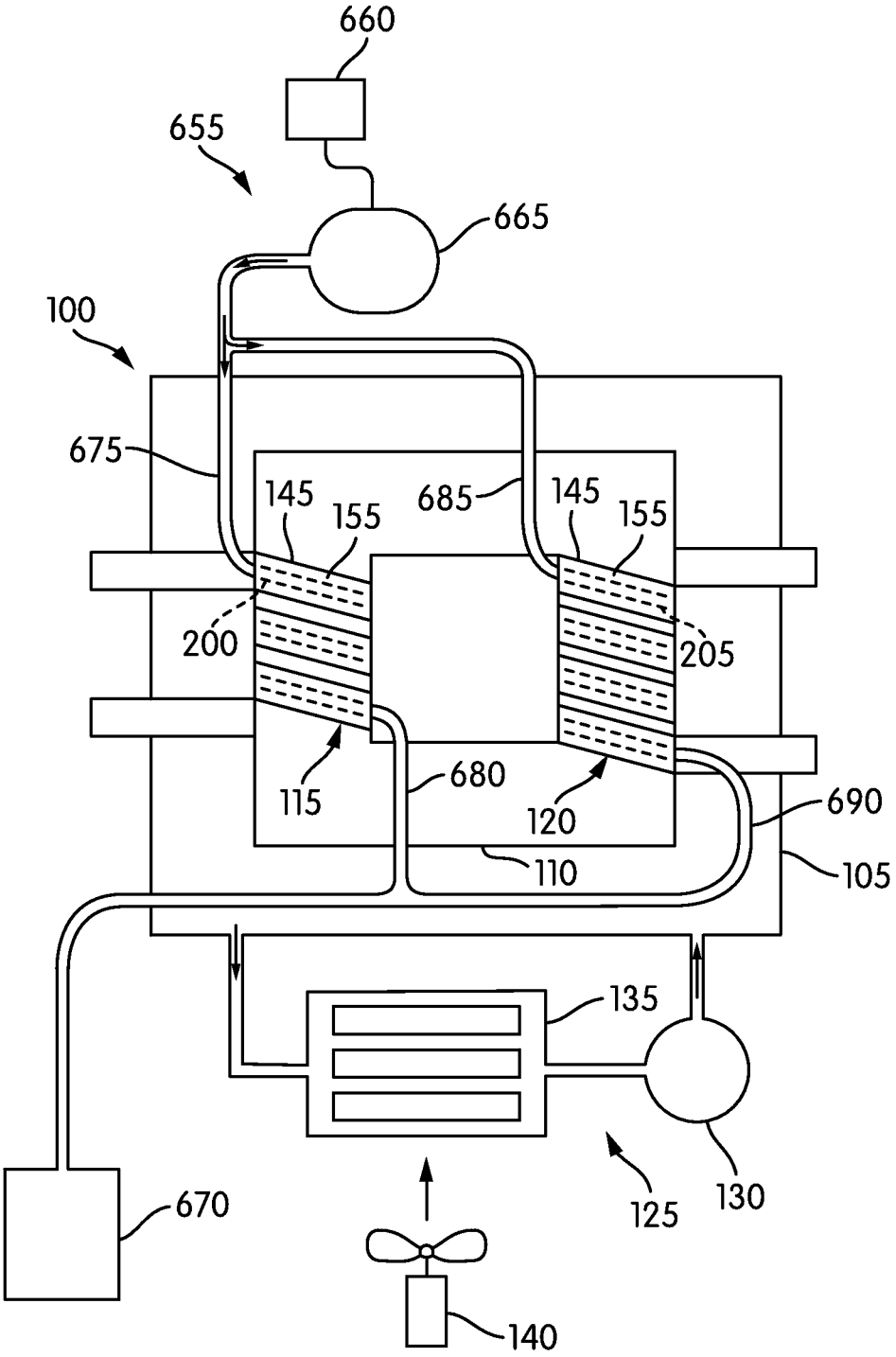
FIG. 13 is a schematic diagram of an electrical device, shown according to an exemplary embodiment.

Referring to FIG. 13, a transformer 100, a primary cooling system 125, and a secondary cooling system 655 are shown, according to an exemplary embodiment. The secondary cooling system 655 is similar to the secondary cooling system 150. The secondary cooling system 655 includes an actuator 660, a pump 665, a primary winding passage 200 formed within the interior portion 150 of the primary winding 115, a secondary winding passage 205 formed within the interior portion 150 of the secondary winding 120, a secondary cooling fluid, an external heat sink 670, and multiple conduits. Conduit 675 connects the pump 665 and the primary winding passage 200. Conduit 680 connects the primary winding passage 200 and the heat sink 670. Conduit 685 connects the pump 665 and the secondary winding passage 205. Conduit 690 connects the secondary winding passage 205 and the heat sink 670.

The secondary cooling system 655 is an open loop system in which the secondary cooling fluid does not return to its source, the pump 665. Instead, after passing through the primary winding 115 and the secondary winding 120, the secondary cooling fluid flows to the external heat sink 670, where the now-heated secondary cooling fluid is cooled. The external heat sink 670 is thermally coupled to atmosphere, a body of water (e.g., a lake or a river), or other medium capable of cooling the now-heated secondary cooling fluid. This type of open loop system can be used with the secondary cooling systems previously described and shown in FIGS. 1-10.

Figure 14:
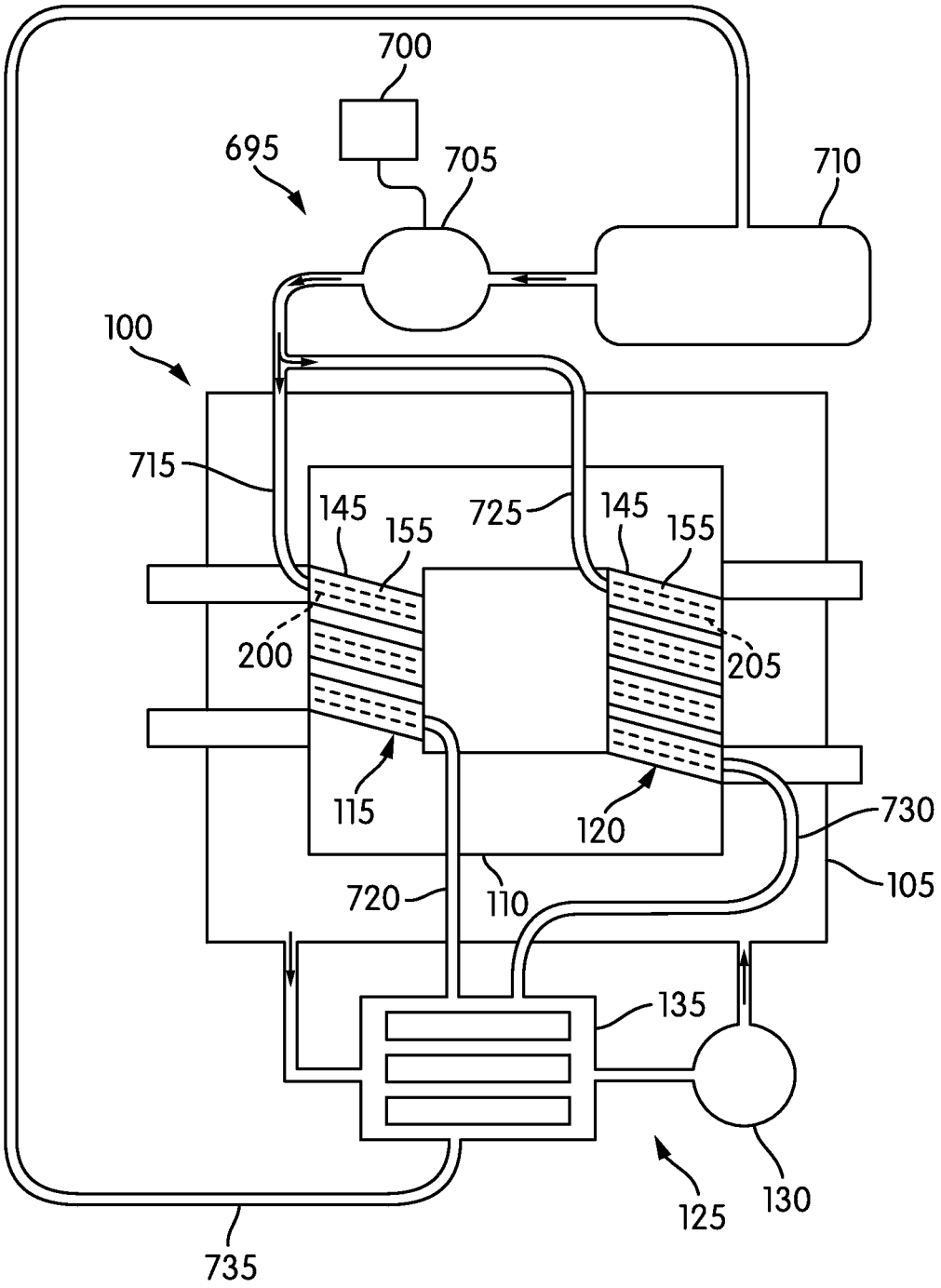
FIG. 14 is a schematic diagram of an electrical device, shown according to an exemplary embodiment.

Referring to FIG. 14, a transformer 100, a primary cooling system 125, and a secondary cooling system 695 are shown, according to an exemplary embodiment. The secondary cooling system 695 is similar to the secondary cooling system 150. The secondary cooling system 150 includes an actuator 700, a pump 705, a primary winding passage 200 formed within the interior portion 150 of the primary winding 115, a secondary winding passage 205 formed within the interior portion 150 of the secondary winding 120, a fluid return reservoir 710, a secondary cooling fluid, and multiple conduits. Conduit 715 connects the pump 705 and the primary winding passage 200. Conduit 720 connects the primary winding passage 200 and the heat exchanger 135. Conduit 725 connects the pump 705 and the secondary winding passage 205. Conduit 730 connects the secondary winding passage 205 and the heat exchanger 135. Conduit 735 connects the heat exchanger 135 and the fluid return reservoir 710. Conduit 740 connects the fluid return reservoir 710 and the pump 705. Alternatively, the fluid return reservoir 710 is omitted and the heat exchanger 135 is directly connected to the pump 705.

The primary cooling system 125 and the secondary cooling system 695 are thermally coupled to the shared heat exchanger 135. In this way, the primary cooling fluid and the secondary cooling fluid are both cooled in the same heat exchanger 135. In some embodiments, the primary cooling fluid and the secondary cooling fluid remain separate from one another. In other embodiments, the primary cooling fluid and the secondary cooling fluid are shared between the primary cooling system 125 and the secondary cooling system 695, with cooling fluid being directed or provided to the secondary cooling system 695 as needed. In some embodiments, the secondary cooling system 695 is activated in response to an activation signal indicative of a sensed condition of the transformer 100, or a predicted condition of the transformer 100, or an external command. For example, the external command can be an input to activate the secondary cooling system 695 via an activate push button or other user interface. The secondary cooling system 695 can be activated in response to a sensed condition or a predicted condition of the transformer 100 as explained above with respect to several exemplary embodiments. The secondary cooling system 695 can also be activated by changing the thermal performance of the secondary cooling system 695 (e.g., changing the flow rate or temperature of the cooling fluid through the secondary cooling system 695).

The construction and arrangement of the elements of the electrical devices and methods as shown in the exemplary embodiments are illustrative only. Although only a few embodiments of the present application have been described in detail, those skilled in the art who review this application will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present application. The order or sequence of any process or method steps may be varied or re-sequenced according to alternative embodiments. Other substitutions, modifications, changes, and omissions may be made in the design, operating conditions, and arrangement of the preferred and other exemplary embodiments without departing from scope of the present application or from the scope of the appended claims.

The present application contemplates methods, systems and program products on any machine-readable media for accomplishing various operations. The embodiments of the present application may be implemented using existing computer processors, or by a special purpose computer processor for an appropriate system, incorporated for this or another purpose, or by a hardwired system. Embodiments within the scope of the present application include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show or the description may provide a specific order of method steps, the order of the steps may differ from what is depicted. Also two or more steps may be performed concurrently or with partial concurrence. Such variation will depend on various factors, including software and hardware systems chosen and on designer choice. All such variations are within the scope of the application. Likewise, software implementations could be accomplished with standard programming techniques with rule based logic and other logic to accomplish the various connection steps, processing steps, comparison steps and decision steps. It should be understood that the present application is not limited to the details or methodology set forth in the description or illustrated in the figures. It should also be understood that the terminology is for the purpose of description only and should not be regarded as limiting.

The invention claimed is:

1. A transformer, comprising:

a core;

a winding wrapped around the core, the winding including an interior portion and an exterior surface, wherein a passage is formed within the interior portion of the winding;

a primary cooling system for cooling the exterior surface of the winding;

a secondary cooling system including a high-pressure fluid source fluidly coupled to the passage formed within the interior portion of the winding to provide a cooling fluid to the passage for cooling the interior portion of the winding;

a current sensor for detecting current through the transformer; and an actuator configured to activate the secondary cooling system in response to an activation signal indicating a predicted condition of the transformer, wherein the predicted condition is based on an amount of transient current flow through the transformer detected by the current sensor and a duration of transient current flow through the transformer detected by the current sensor.

2. The transformer of claim 1, wherein the actuator activates the high-pressure fluid source in response to an activation signal such that the high-pressure fluid source provides the cooling fluid to the passage, thereby cooling the interior portion of the winding.

3. The transformer of claim 2, wherein the secondary cooling system is a closed loop system so that the cooling fluid returns to the high-pressure fluid source after passing through the passage.

4. The transformer of claim 2, wherein the secondary cooling system further includes an external heat sink such that the cooling fluid flows to the external heat sink after passing through the passage.

5. The transformer of claim 1, wherein the cooling fluid undergoes a phase change in the passage.

6. The transformer of claim 1, wherein the high-pressure fluid source includes a pump or an accumulator.

7. The transformer of claim 1, further comprising:

a heat exchanger thermally coupled to the secondary cooling system.

8. The transformer of claim 7, wherein the heat exchanger is thermally coupled to the primary cooling system.

9. The transformer device of claim 1, wherein the actuator is further configured to modify the thermal performance of the secondary cooling system in response to a second activation signal.

10. The transformer of claim 1, wherein the core is cooled by the primary cooling system or by the secondary cooling system.

11. The transformer of claim 1, further comprising:

a cooling fluid shared by the primary cooling system and the secondary cooling system; and wherein the cooling fluid is directed to the secondary cooling system as needed.

* * * * *